US010557303B1

(12) United States Patent
Tapp

(10) Patent No.: US 10,557,303 B1
(45) Date of Patent: Feb. 11, 2020

(54) WATER TROUGH WINDOW SEAL ASSEMBLY

(71) Applicant: Richard Tapp, Sandy, UT (US)

(72) Inventor: Richard Tapp, Sandy, UT (US)

( * ) Notice: Subject to any disclaimer, the term of this patent is extended or adjusted under 35 U.S.C. 154(b) by 0 days.

(21) Appl. No.: 16/218,577

(22) Filed: Dec. 13, 2018

(51) Int. Cl.
*E06B 7/14* (2006.01)
*E06B 1/62* (2006.01)

(52) U.S. Cl.
CPC ..... *E06B 7/14* (2013.01); *E06B 1/62* (2013.01); *E06B 2001/628* (2013.01)

(58) Field of Classification Search
CPC ..... E06B 7/14; E06B 1/62; E06B 2001/628
USPC ..... 52/58, 741.4, 288.1, 381, 443
See application file for complete search history.

(56) References Cited

U.S. PATENT DOCUMENTS 2,696,280 A 12/1954 Bourne
6,513,288 B1 * 2/2003 MacDonald ..... E04B 2/7435 160/137
6,698,144 B1 3/2004 Larson
7,877,951 B2 * 2/2011 Jacobsen ..... E06B 1/62 277/650
8,833,019 B2 9/2014 Rutherford
8,966,839 B2 * 3/2015 Rebman ..... E06B 3/28 52/202
D762,310 S 7/2016 Apanovich
9,453,366 B2 9/2016 Markham
9,512,666 B2 * 12/2016 Reyher ..... E06B 1/36
2005/0000174 A1 * 1/2005 Wirawan ..... E06B 1/36 52/204.1
2005/0055901 A1 * 3/2005 Valentz ..... E04D 13/0315 52/198
2005/0210777 A1 * 9/2005 Baughn ..... E06B 3/9682 52/202
2008/0016798 A1 * 1/2008 Miller ..... E06B 9/581 52/202
2011/0239562 A1 * 10/2011 Ryan ..... E06B 7/16 52/209
2013/0008106 A1 * 1/2013 Michaud ..... E06B 1/68 52/213
2013/0186009 A1 7/2013 Hart
2017/0130462 A1 5/2017 Maziarz

* cited by examiner

*Primary Examiner* — Joshua K Ihezie

(57) ABSTRACT

A water trough window seal trim assembly for preventing water leakage includes a plurality of trim sections comprising a top trim section, a left trim section, and a right trim section. Each of the plurality of trim sections comprises a bottom piece, an exterior perpendicular piece, an interior perpendicular piece, and a parallel piece. The bottom piece has an exterior end, an interior end, a top face, and a bottom face. The exterior perpendicular piece is perpendicularly coupled to the top face at the exterior end. The interior perpendicular piece is perpendicularly coupled to the top face proximal the interior end. The parallel piece is perpendicularly coupled to each of the exterior perpendicular piece and the interior perpendicular piece to form a water trough. A pair of corner connectors perpendicularly couples each of the left trim section and the right trim section to the top trim section.

7 Claims, 5 Drawing Sheets

WATER TROUGH WINDOW SEAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to window trims and more particularly pertains to a new window trim for preventing water leakage.

BRIEF SUMMARY OF THE INVENTION

An embodiment of the disclosure meets the needs presented above by generally comprising a plurality of trim sections comprising a top trim section, a left trim section, and a right trim section. Each of the plurality of trim sections comprises a bottom piece, an exterior perpendicular piece, an interior perpendicular piece, and a parallel piece. The bottom piece has an exterior end, an interior end, a top face, and a bottom face. The exterior perpendicular piece is perpendicularly coupled to the top face at the exterior end and is configured to be disposed between a window frame and an outer wall. The interior perpendicular piece is perpendicularly coupled to the top face proximal the interior end. The parallel piece is perpendicularly coupled to each of the exterior perpendicular piece and the interior perpendicular piece and is thus parallel to the bottom piece. The parallel piece forms a water trough between the exterior perpendicular piece and the interior perpendicular piece. The bottom piece, the exterior perpendicular piece, the interior perpendicular piece, and the parallel piece form a rectangular channel. A pair of corner connectors perpendicularly couples each of the left trim section and the right trim section to the top trim section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
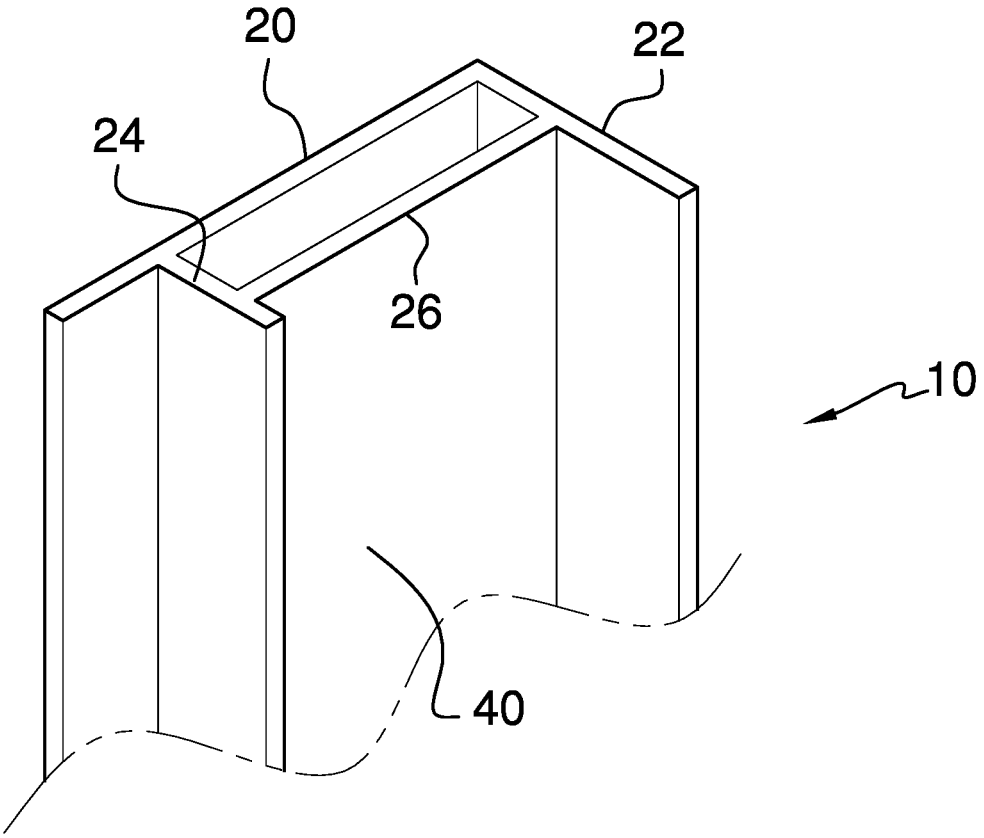
FIG. 1 is an isometric view of a water trough window seal trim assembly according to an embodiment of the disclosure.
Figure 2:
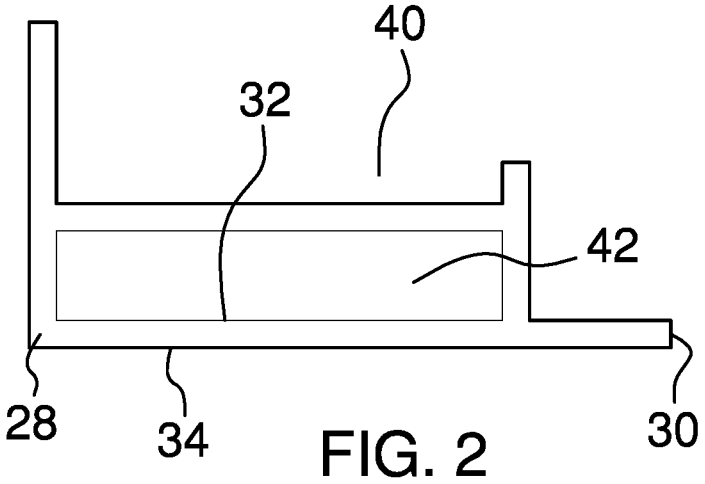
FIG. 2 is a bottom plan view of an embodiment of the disclosure.
Figure 3:
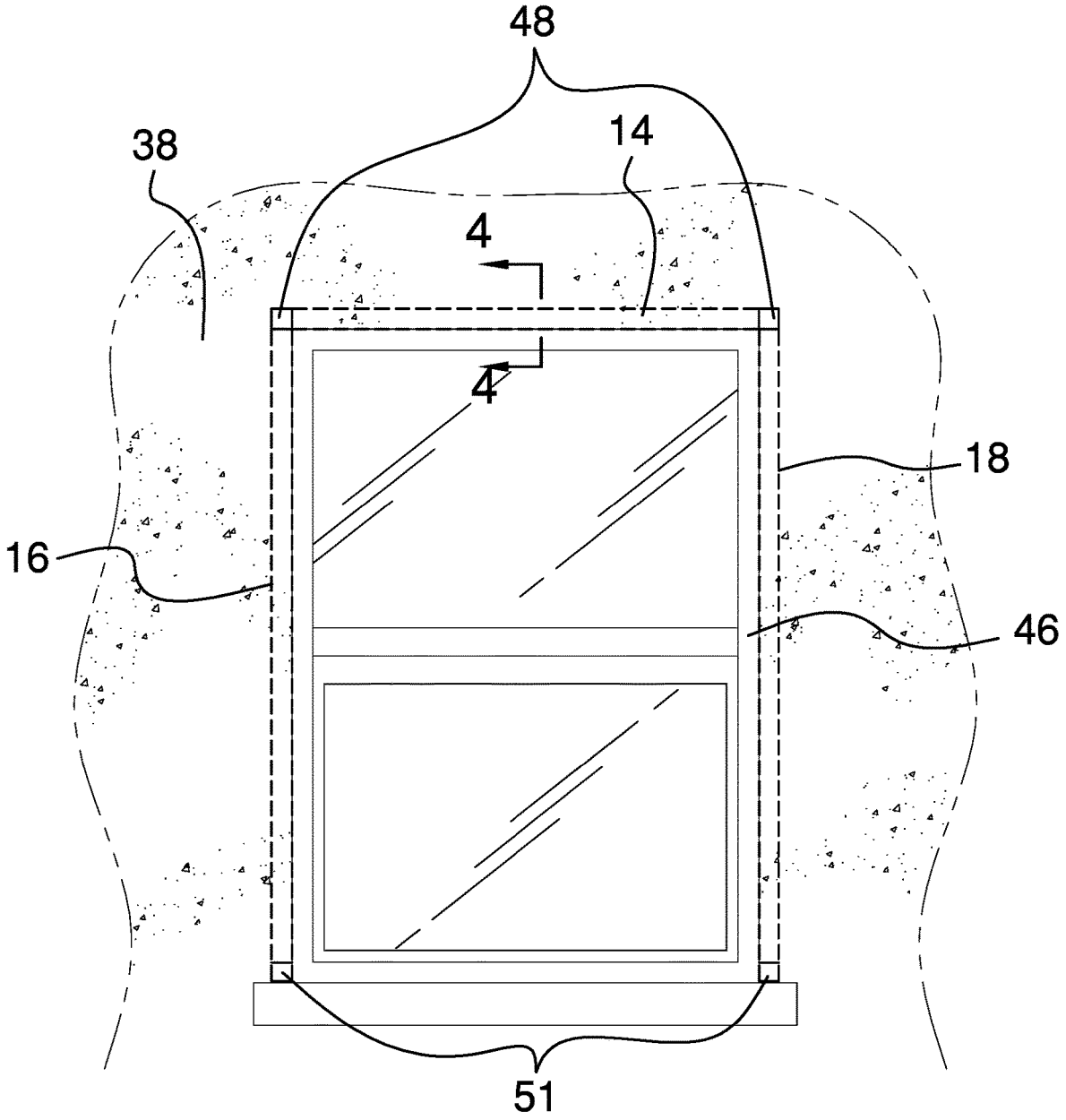
FIG. 3 is an in-use view of an embodiment of the disclosure.
Figure 4:
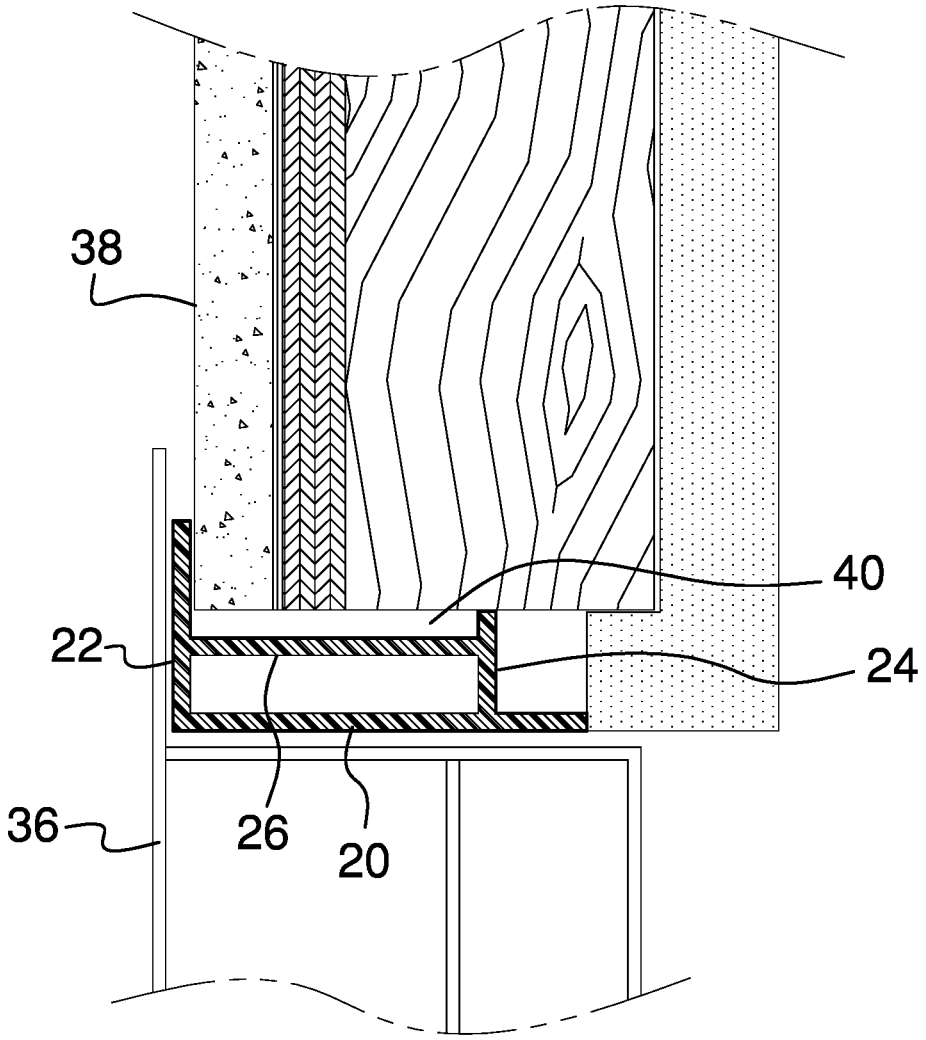
FIG. 4 is a cross-sectional view of an embodiment of the disclosure along line 4-4 of FIG. 3.
Figure 5:
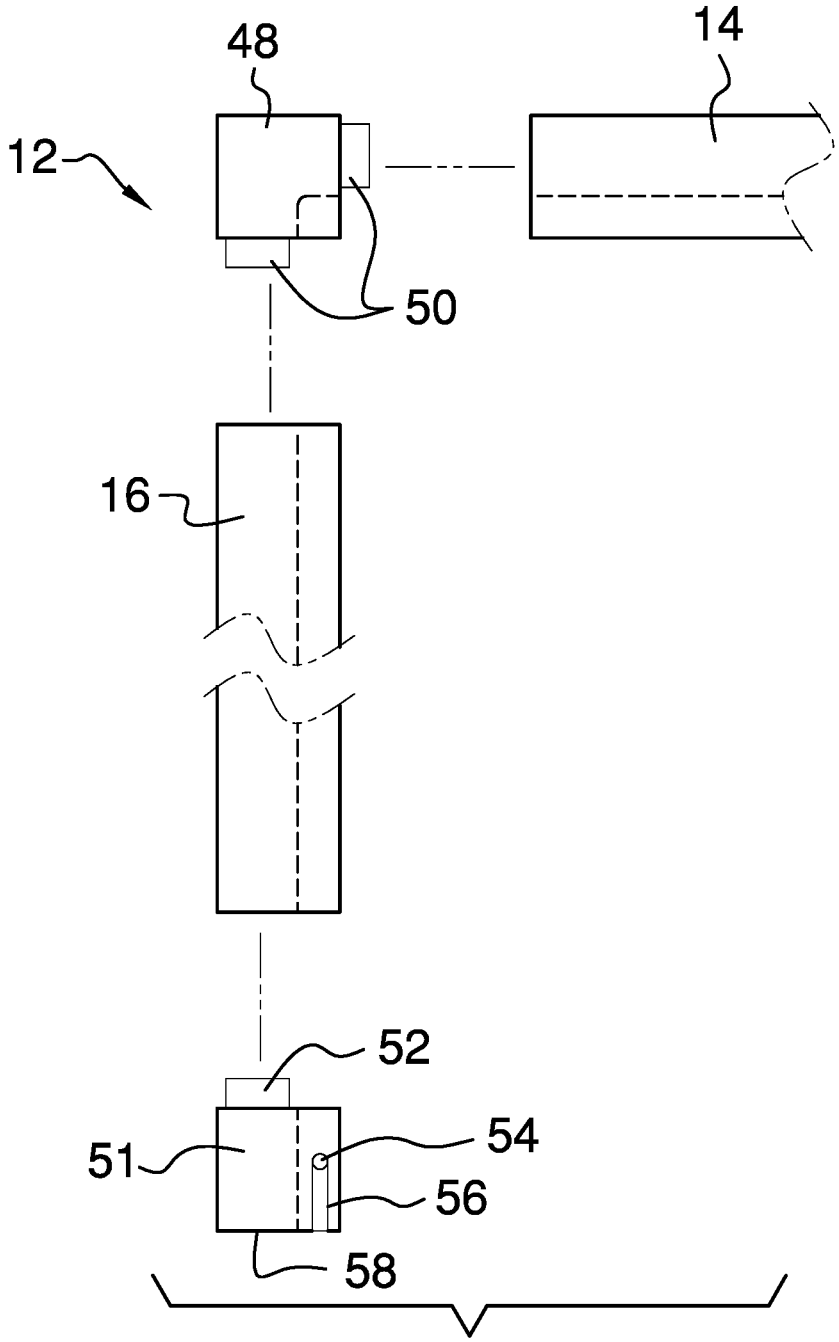
FIG. 5 is an exploded view of an embodiment of the disclosure.
Figure 6:
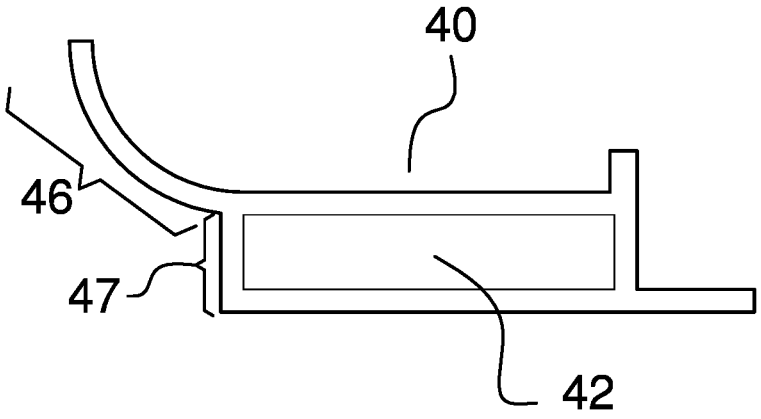
FIG. 6 is a bottom plan view of an embodiment of the disclosure.

With reference now to the drawings, and in particular to FIGS. 1 through 6 thereof, a new window trim embodying the principles and concepts of an embodiment of the disclosure and generally designated by the reference numeral 10 will be described.

As best illustrated in FIGS. 1 through 6, the water trough window seal trim assembly 10 generally comprises a plurality of trim sections 12 comprising a top trim section 14, a left trim section 16, and a right trim section 18. Each of the plurality of trim sections 12 comprises a bottom piece 20, an exterior perpendicular piece 22, an interior perpendicular piece 24, and a parallel piece 26. The bottom piece 20 has an exterior end 28, an interior end 30, a top face 32, and a bottom face 34. The exterior perpendicular piece 22 is perpendicularly coupled to the top face 32 at the exterior end 28. The exterior perpendicular piece 22 is configured to be disposed between a window frame 36 and an outer wall 38. The interior perpendicular piece 24 is perpendicularly coupled to the top face 32 proximal the interior end 30. The parallel piece 26 is perpendicularly coupled to each of the exterior perpendicular piece 22 and the interior perpendicular piece 24. The parallel piece 26 is thus parallel to the bottom piece 20 and forms a water trough 40 between the exterior perpendicular piece 22 and the interior perpendicular piece 24. The bottom piece 20, the exterior perpendicular piece 22, the interior perpendicular piece 24, and the parallel piece 26 form a rectangular channel 42. The exterior perpendicular piece 22 may have a straight section 44 extending from the bottom piece 20 to the parallel piece 26 and a curved section 46 extending above the parallel piece 26. The curved section 46 is concave relative the parallel piece 26 and is configured to fit the outer wall 38 when it is rounded.

A pair of corner connectors 48 perpendicularly couples each of the left trim section 16 and the right trim section 18 to the top trim section 14. Each of the pair of corner connectors 48 may have a pair of extensions 50. Each of the pair of extensions 50 is selectively engageable with the rectangular channel 42. There may also be an end trim section 51 having a tongue 52. The tongue 52 is selectively engageable with the rectangular channel 42 of either the left trim section 16 or the right trim section 18. The end trim section 51 may have a drain aperture 54 and a drain channel 56. The drain aperture 54 is in fluid communication with the water trough 40 and the drain channel 56 extends from the drain aperture to a bottom edge 58 of the end trim section.

In use, the plurality of trim sections 12 joined by the pair of corner connectors 48 is installed around the window frame 36. Water that runs down the outer wall 38 and gets behind the exterior perpendicular piece 22 enters the water trough 40. The water then flows down the water trough of the left trim section 16 and the right trim section 18, and if present through the drain aperture 56 of the end trim section and down the drain channel 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A water trough window seal trim assembly comprising:

a plurality of trim sections, the plurality of trim sections comprising a top trim section, a left trim section, and a right trim section, each of the plurality of trim sections comprising:

a bottom piece, the bottom piece having an exterior end, an interior end, a top face, and a bottom face;

an exterior perpendicular piece coupled to the bottom piece, the exterior perpendicular piece being perpendicularly coupled to the top face at the exterior end, the exterior perpendicular piece being configured to be disposed between a window frame and an outer wall;

an interior perpendicular piece coupled to the bottom piece, the interior perpendicular piece being perpendicularly coupled to the top face proximal the interior end; and a parallel piece coupled to each of the exterior perpendicular piece and the interior perpendicular piece, the parallel piece being perpendicularly coupled to each of the exterior perpendicular piece and the interior perpendicular piece, the parallel piece thus being parallel to the bottom piece, the parallel piece forming a water trough between the exterior perpendicular piece and the interior perpendicular piece;

wherein the bottom piece, the exterior perpendicular piece, the interior perpendicular piece, and the parallel piece form a rectangular channel;

a pair of corner connectors, each of the pair of corner connectors perpendicularly coupling each of the left trim section and the right trim section to the top trim section; and an end trim section, the end trim section being selectively engageable with either the left trim section or the right trim section, the end trim section having a drain aperture, the drain aperture being in fluid communication with the water trough.

2. The water trough window seal trim assembly of claim 1 further comprising each of the pair of corner connectors having a pair of extensions, each of the pair of extensions being selectively engageable with the rectangular channel.

3. The water trough window seal trim assembly of claim 1 further comprising the end trim section having a tongue, the tongue being selectively engageable with the rectangular channel.

4. The water trough window seal trim assembly of claim 3 further comprising the end trim section having a drain channel, the drain channel extending from the drain aperture to a bottom edge of the end trim section.

5. The water trough window seal trim assembly of claim 1 further comprising the exterior perpendicular piece having a straight section and a curved section, the straight section extending from the bottom piece to the parallel piece, the curved section being concave relative to the parallel piece.

6. A water trough window seal trim assembly comprising:

a plurality of trim sections, the plurality of trim sections comprising a top trim section, a left trim section, and a right trim section, each of the plurality of trim sections comprising:

a bottom piece, the bottom piece having an exterior end, an interior end, a top face, and a bottom face;

an exterior perpendicular piece coupled to the bottom piece, the exterior perpendicular piece being perpendicularly coupled to the top face at the exterior end, the exterior perpendicular piece being configured to be disposed between a window frame and an outer wall;

an interior perpendicular piece coupled to the bottom piece, the interior perpendicular piece being perpendicularly coupled to the top face proximal the interior end; and a parallel piece coupled to each of the exterior perpendicular piece and the interior perpendicular piece, the parallel piece being perpendicularly coupled to each of the exterior perpendicular piece and the interior perpendicular piece, the parallel piece thus being parallel to the bottom piece, the parallel piece forming a water trough between the exterior perpendicular piece and the interior perpendicular piece;

wherein the bottom piece, the exterior perpendicular piece, the interior perpendicular piece, and the parallel piece form a rectangular channel;

a pair of corner connectors, each of the pair of corner connectors having a pair of extensions, each of the pair of extensions being selectively engageable with the rectangular channel, each of the pair of corner connectors perpendicularly coupling each of the left trim section and the right trim section to the top trim section; and an end trim section, the end trim section having a tongue, the tongue being selectively engageable with the rectangular channel, the end trim section being selectively engageable with either the left trim section or the right trim section, the end trim section having a drain aperture and a drain channel, the drain aperture being in fluid communication with the water trough, the drain channel extending from the drain aperture to a bottom edge of the end trim section.

7. A water trough window seal trim assembly comprising:

a plurality of trim sections, the plurality of trim sections comprising a top trim section, a left trim section, and a right trim section, each of the plurality of trim sections comprising:

a bottom piece, the bottom piece having an exterior end, an interior end, a top face, and a bottom face;

an exterior perpendicular piece coupled to the bottom piece, the exterior perpendicular piece being perpendicularly coupled to the top face at the exterior end, the exterior perpendicular piece having a straight section and a curved section, the exterior perpendicular piece being configured to be disposed between a window frame and an outer wall;

an interior perpendicular piece coupled to the bottom piece, the interior perpendicular piece being perpendicularly coupled to the top face proximal the interior end; and a parallel piece coupled to each of the exterior perpendicular piece and the interior perpendicular piece, the parallel piece being perpendicularly coupled to each of the exterior perpendicular piece and the interior perpendicular piece, the parallel piece being coupled between the straight section and the curved section of the exterior perpendicular piece, the parallel piece thus being parallel to the bottom piece, the parallel piece forming a water trough between the exterior perpendicular piece and the interior perpendicular piece;

wherein the bottom piece, the exterior perpendicular piece, the interior perpendicular piece, and the parallel piece form a rectangular channel;

a pair of corner connectors, each of the pair of corner connectors having a pair of extensions, each of the pair of extensions being selectively engageable with the rectangular channel, each of the pair of corner connectors perpendicularly coupling each of the left trim section and the right trim section to the top trim section; and an end trim section, the end trim section having a tongue, the tongue being selectively engageable with the rectangular channel, the end trim section being selectively engageable with either the left trim section or the right trim section, the end trim section having a drain aperture and a drain channel, the drain aperture being in fluid communication with the water trough, the drain channel extending from the drain aperture to a bottom edge of the end trim section.

* * * * *